United States Patent [19]

Haneda et al.

[11] Patent Number: 4,789,612

[45] Date of Patent: Dec. 6, 1988

[54] METHOD FOR FORMING COLOR IMAGE

[75] Inventors: Satoshi Haneda; Kunihisa Yoshino, both of Hachioji, Japan

[73] Assignee: Konishiroku Photo Industry Co., Ltd., Tokyo, Japan

[21] Appl. No.: 18,490

[22] Filed: Feb. 24, 1987

[30] Foreign Application Priority Data

Mar. 6, 1986 [JP] Japan ..... 61-49086
Mar. 6, 1986 [JP] Japan ..... 61-49091

[51] Int. Cl.[4] ..... G03G 13/24; G03G 13/01

[52] U.S. Cl. ..... 430/42; 430/45; 430/55; 430/46; 355/4

[58] Field of Search ..... 430/42, 45, 47

[56] References Cited

U.S. PATENT DOCUMENTS 3,413,117 11/1968 Gaynor ..... 430/45 X
3,458,309 7/1969 Gaynor ..... 430/45 X
4,696,880 9/1987 Shoji et al. ..... 430/42

FOREIGN PATENT DOCUMENTS 2524164 9/1983 France ..... 430/42
60-225855 11/1985 Japan .
61-65262 4/1986 Japan .

*Primary Examiner*—Roland E. Martin
*Attorney, Agent, or Firm*—Frishauf, Holtz, Goodman & Woodward

[57] ABSTRACT

A method for forming a color image comprising the following steps is disclosed, (a) uniformly applying a primary charge to a photoreceptor comprised thereon of a conductive substrate, a photoconductive layer and an electrically insulating layer, wherein one of said layers is provided with plural kinds of color separating means being finely divided into units, (b) exposing said photoreceptor to light given from a color original and simultaneously applying secondary charge, (c) uniformly exposing said photoreceptor to a color light capable of passing through at least one kind of said color separating means to form an electrically charged image pattern, (d) developing said electrically charged pattern with a developer comprising a color toner by a developing means to form a toner pattern, (e) repeating said steps (c) and (d) at least once more, (f) transferring said toner pattern onto an image pattern receiving material, provided that the color light and the color toner each different from these in the every previous steps are used and (g) fixing said image patterns transferred on said image pattern receiving material, wherein an area of said toner image pattern formed on an individual unit of said color separating means is larger than an area of said individual unit. A color image improved in a color tone and a color density can be obtained.

4 Claims, 9 Drawing Sheets

METHOD FOR FORMING COLOR IMAGE

FIELD OF THE INVENTION

The present invention relates to a method for forming a color image, and more particularly to a method for forming a color image using an electrophotography.

BACKGROUND OF THE INVENTION

Various methods for forming a multicolor image using electrophotography have been proposed. These methods are divided into the following two categories. One is to repeat a formation of an electrostatic latent image whose colors have been separated and the development thereof so as to superimpose the colors on a photoreceptor or transfer a toner image to a transfer material each time a development is carried out so as to superimpose colors on the transfer material. The other is to form a toner image in different colors on a plurality of photoreceptors provided correspondingly to the number of colors at the same time, and thereafter, to transfer them sequentially to a transfer material so as to obtain a multicolor image. The latter has an advantage that a color image is formed at a high. However, it requires a plurality of photoreceptors and light exposure means, thus causing a device of this kind to be complicated and large in its construction, which means that the device is expensive, i.e., it lacks practical use. In addition, both methods have a disadvantage that it is difficult to superimpose colors accurately. Accordingly, the registration of colors cannot be carried out satisfactorily.

In order to solve these problems, the inventors proposed a device in which a multicolor image is formed by carrying out an image exposure once on a photoreceptor before the present patent application was filed with the Japanese Patent Office. A multicolor formation is carried out by a device having a photoreceptor comprising a conductive substrate, a photoconductive layer, and an electrically insulating layer containing filter layers composed of plural kinds of finely divided filter units which serves as color separating means. By charging and exposing the photoreceptor, an image is formed on the photoreceptor according to the charge density generated at the boundary between the insulating layer and the photoconductive layer. Thereafter, by uniformly exposing the surface on which the image has been formed by means of a light which permeates through only one kind of filter units of the plural kinds of filter units, an electrical charged pattern is formed on the filter unit of the photoreceptor, and then, the electrical charged pattern is developed by a developing unit which accommodates toners in a specific color so as to form a monochrome toner image. After the electrification provided with photoreceptor is smoothed, the surface of the photoreceptor is uniformly exposed by a light which permeates through the filter units different from the filter unit previously charged and a development is carried out by a developing unit which accommodates toners in a color different from the above-described one, whereby a toner image different from the previously formed image is formed on the photoreceptor. Thereafter, necessary numbers of uniform image exposures and developments are carried out. As a result, toners in different colors adhere to the corresponding filter units in the photoreceptor to form a multicolor image. This method has been disclosed in Japanese Patent Publication Open to Public Inspection Nos. 225855/1985 and 65262/1986. (Hereinafter referred to as Japanese Patent O.P.I. Publication.) According to this multicolor image forming devices, it is unnecessary to carry out image exposures more than once. Therefore, a color doubling never occurs.

According to the above-described multicolor image forming method, a color reproduction is carried out by not superimposing colors at the same position, namely, by additive color process. Accordingly, the above-described color doubling does not occur and a color reproduction is performed favorably.

There is, however, a problem in the above method that, as shown in FIG. 3, since a respective toner adheres only to a corresponding filter, an image density thus obtained is unfavorable.

SUMMARY OF THE INVENTION

It is therefore an object of the present invention to provide an image forming method which utilizes the methods disclosed in Japanese Patent O.P.I. Publication Nos. 225855/1985 and 65262/1986 and is capable of forming an image having a more favorable image density. The above-described object of the present invention is attained by the following color image forming method.

A method for forming a color image comprising steps of (a) uniformly applying a primary charge to a photoreceptor comprising a conductive substrate, a photoconductive layer and an electric insulating layer, wherein one of said layers is provided with plural kinds of color separating means being finely divided into units, (b) exposing the photoreceptor to a color original simultaneously applying secondary charge, (c) uniformly exposing the photoreceptor to a color light capable of passing through at least one kind of the color separating means to form an electrically charged pattern, (d) developing the electrically charged pattern with a developer comprising a color toner by a developing means to form a toner pattern, (e) repeating above steps (c) and (d) at least one time except that the color light for the uniform exposing and the color toner are different from these in the every previous steps are used, (f) transferring said toner patterns onto a receiving material, (g) fixing said toner patterns transferred on said receiving material, wherein an area of said toner pattern formed on an individual unit of said color separating means is larger than an area of said individual unit.

According to the color image reproducing method of the present invention, the area of toners which adhere to a filter unit of a color separating means (hereinafter referred to filter unit) is greater than that of the filter unit as shown in FIG. 2. Thus, the toner which adhere to the filter unit and toners which adhere to filter units in different colors disposed adjacent to the filter unit overlap each other, so that a substractive coloration is carried out. Therefore, a reproduced image is allowed to have a high density.

BRIEF DESCRIPTION OF THE DRAWINGS

Except FIG. 3, all the drawings show embodiments of the present invention in which.

Figure 15:
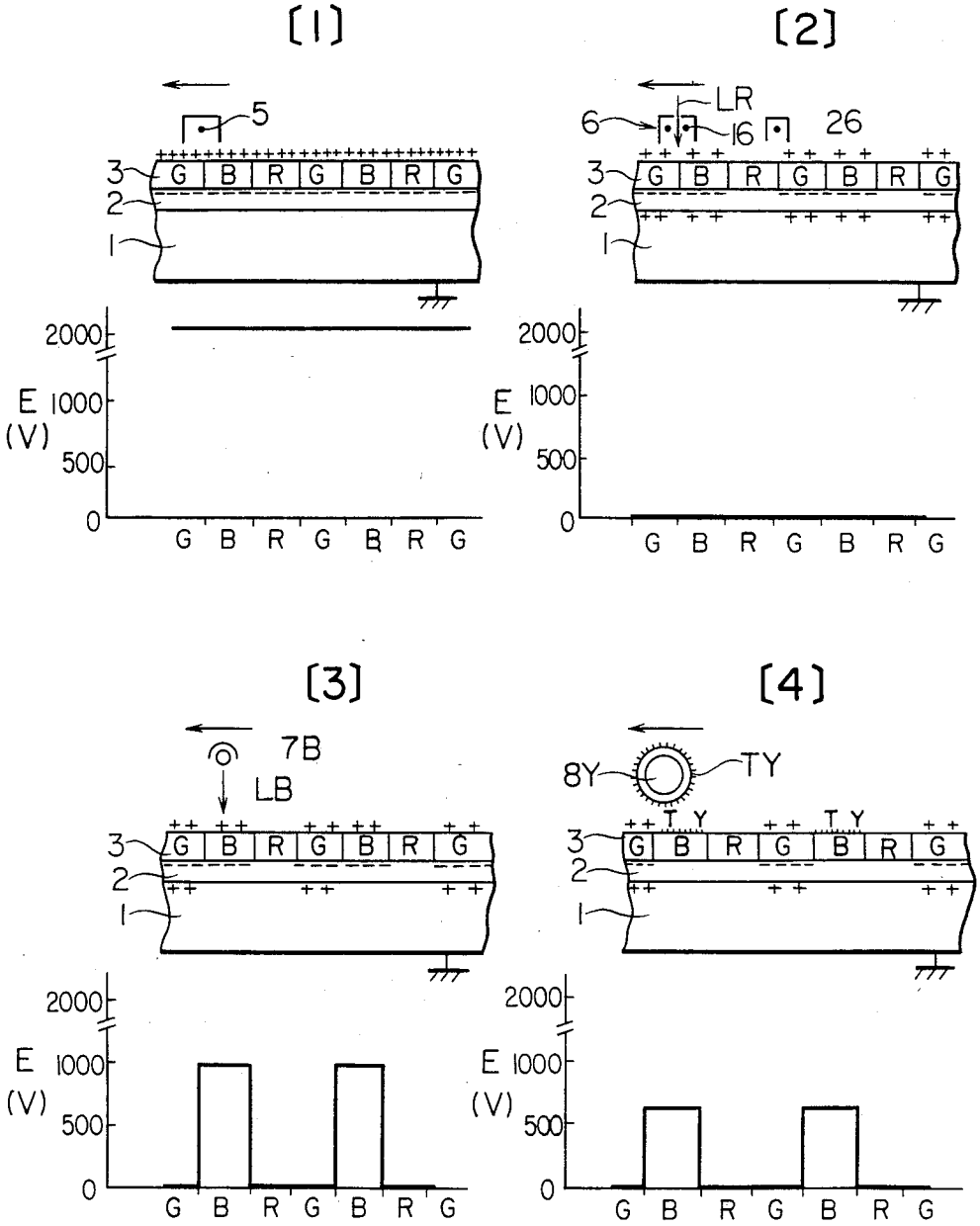
Figure 15:
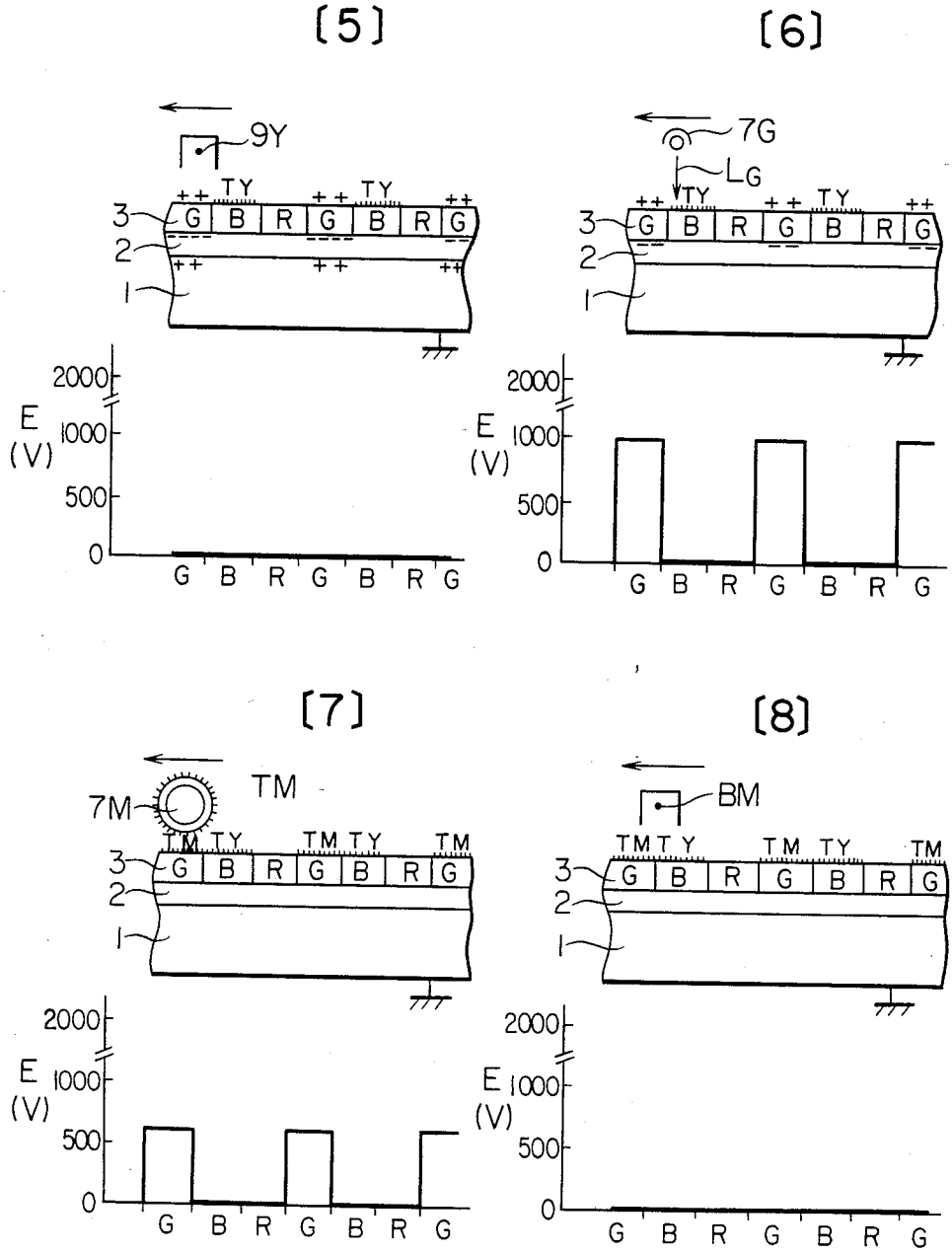

(1) through (8) in FIG. 15 are views for describing the process of an image formation.

Figure 16:
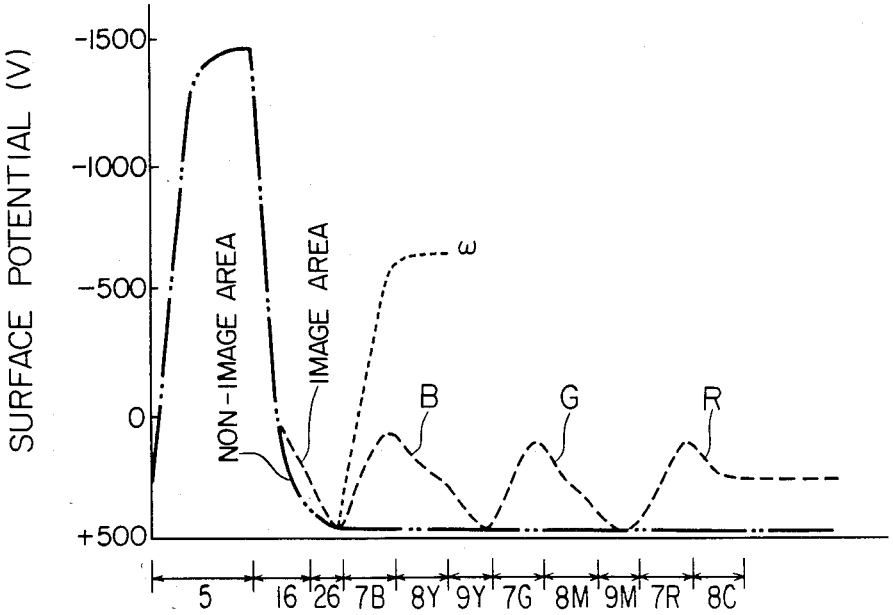

FIG. 16 is a graph showing the change of the potential on the surface of a photoreceptor during an image formation process according an embodiment.

Figure 17:
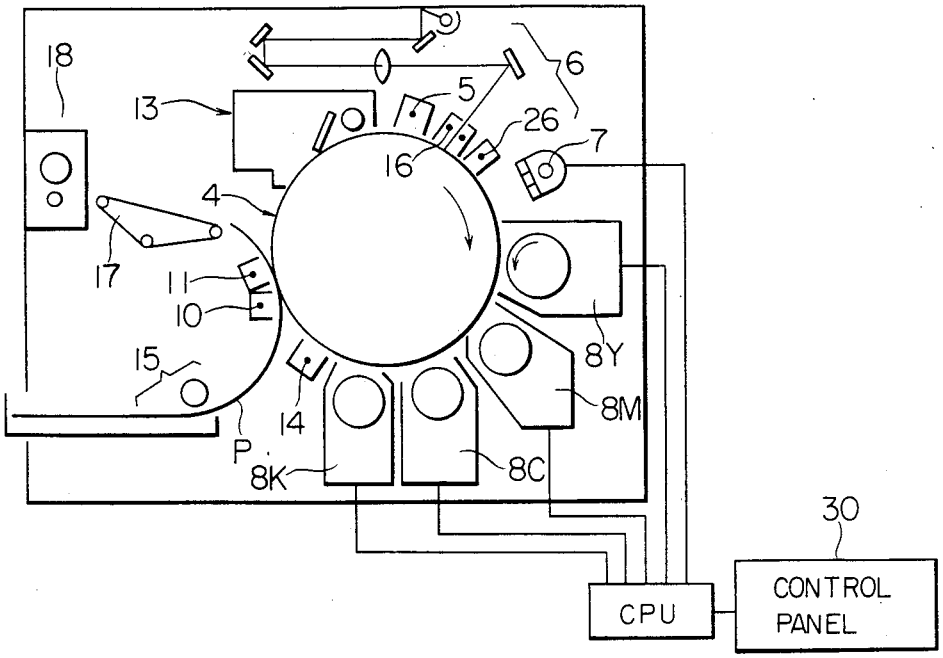

FIG. 17 is a front view showing schematically the internal construction of another image forming device.

Figure 18:
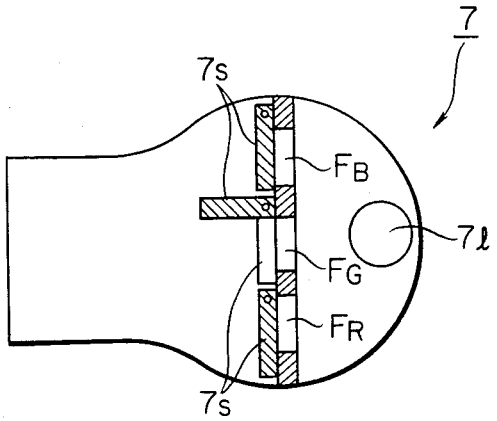

FIG. 18 is a sectional view of a device which uniformly exposes a photoreceptor.

Figure 19:
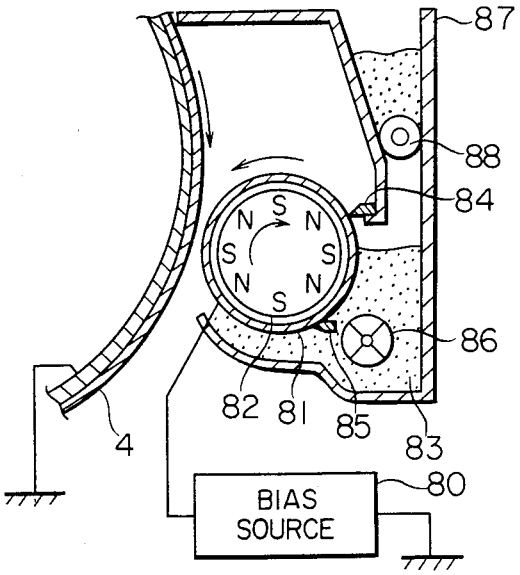

FIG. 19 is a sectional view of a developing device.

DETAILED DESCRIPTION OF THE INVENTION

The present invention will be described with reference to the drawings.

Figure 1:
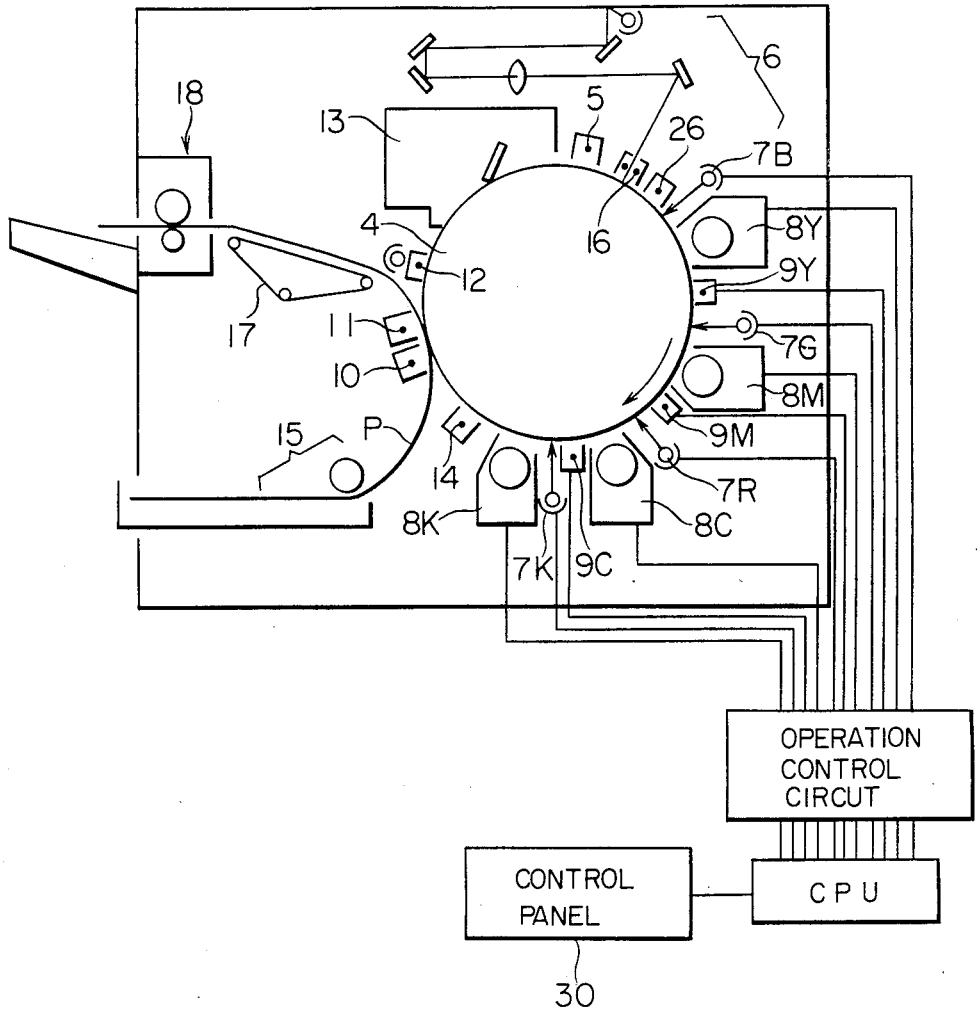
FIG. 1 is a front view showing schematically the internal construction of an image reproducing device.
Figure 10:
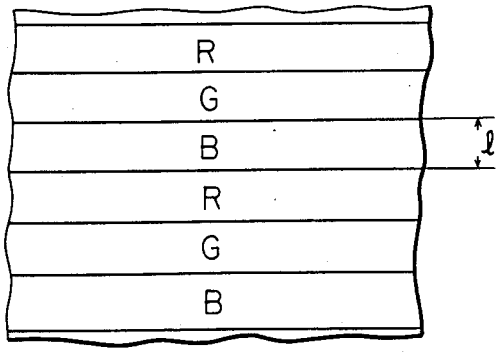
FIGS. 10 through 12 are plan views of photosensitive materials.
Figure 11:
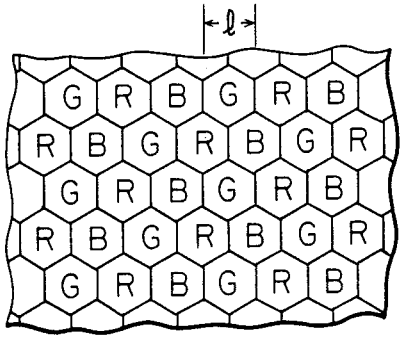
Figure 12:
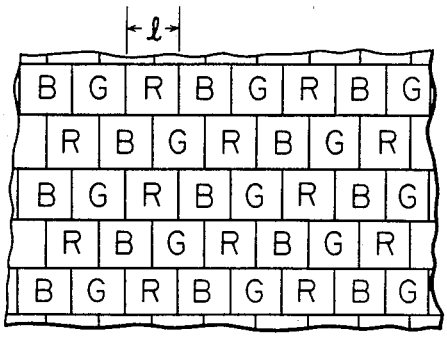

FIGS. 4 through 9, 13, and 14 are sectional views showing the constructions of image carriers (photoreceptor) to be used for the multicolor image forming method according to the present invention. FIGS. 10 through 12 are plan views showing an example of arrangements of a plurality of filter units disposed in electrically insulating layers of a photoreceptor. FIGS. 1 and 17 are schematic views of the construction of a multicolor image forming device according to the present invention. (1) through (8) in FIG. 15 are views showing the steps of forming an image according to the method for forming a multicolor image according to the present invention. FIG. 16 is a graph showing the changes of the surface potential of a photoreceptor according to a toner image forming processes. FIG. 19 is a partial view showing a developing device to be used in the multicolor image forming method according to the present invention.

Figure 4:
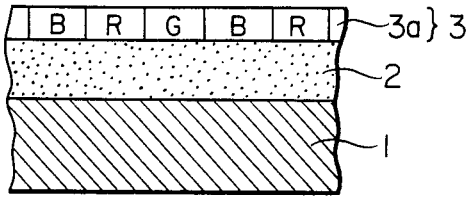
FIGS. 4 through 9, FIGS. 13 and 14 are sectional views of photoreceptors.
Figure 5:
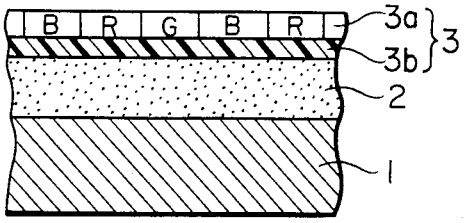
Figure 6:
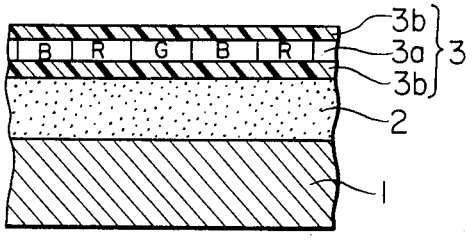
Figure 7:
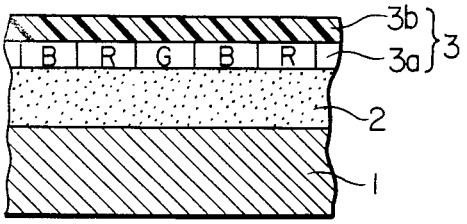

In FIGS. 4 through 7, numeral 1 denotes a conductive substrate to be formed into appropriate constructions and configurations such as cylindrical, endless belt or the like using metals such as aluminum, iron, nickel, copper or an alloy of these metals. Numeral 2 designates a photoconductive layer consisting of organic photoconductive material or a function-separated type photoconductive layer consisting of charge generation layer and charge transfer layer in which the following substances are dispersed in an insulating binder resins such as polyethelene, polyester, polypropylene, polycarbonate, acrylic resin, silicone resin, fluororesin. The substances include photoconductive materials containing sulfur, selenium, amorphous silicon or a photoconductor comprising an alloy containing sulfur, selenium, tellurium, arsenic, antimony or an inorganic photoconductor consisting of metallic oxides, iodides, sulfides, selenides of such as zinc, aluminum, antimony, bismuth, cadmium, molybdenum or an organic photoconductor in which a mixture of azo pigments, disazo pigments, trisazo pigments, phthalocyanine pigments and electrical charge transporting substances such as vinyl carbazole, trinitrofluorenon, polyvinyl carbazole, oxadiazole, hydrazone, stilbene derivatives, styryl derivatives or the like. Numeral 3 indicates an insulating layer containing a layer 3*a* comprising finely divided filter units such as red (R), green (G), blue (B) formed by polymers, resins and colorants such as pigments. The insulating layer 3 in the photoreceptor in FIG. 4 is formed by adhering, an insulating substance such as a resin to which a colorant is added to form color separating means, to finely divided patterns formed on the photoconductive layer 2 by means of printing, vapor deposition, using photoresist or the like. The insulating layer 3 in the photoreceptor in FIG. 5 comprises a transparent insulating layer 3*b* formed by a means known in the art and filter layer 3*a*, which is on the layer 3*b*, formed in finely divided pattern. The insulating layer 3 in the photoreceptor in FIG. 6 comprises a filter layer 3*a* and a transparent insulating layers 3*b* which sandwich the layer 3*a*. The insulating layer 3 in the photoreceptor in FIG. 7 comprises filter layer 3*a* formed on the photoconductive layer 2 and the transparent insulating layer 3*b* formed on the layer 3*a*. These filter layers 3*a* are formed by means of printing, vapor deposition, photoresist or the like.

The insulating layer 3 may be formed by first forming an insulating film or sheet containing the filter layer 3*a*, and thereafter, attaching or adhering the filter layer 3*a* to the photoconductive layer 2 with appropriate means.

Figure 8:
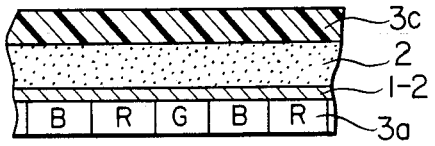

A photoreceptor may have such a construction as proposed by the applicant in Japanese O.P.I. Publication No. 77857/1986, that is, as shown in FIG. 8, the insulating layer 3*c* is formed on one side of the photoconductive layer 2 and a laminating layer of a translucent conductive layer 1-2 and the insulating layer 3*a* composed of filter units on the other side of the photoconductive layer 2. The translucent conductive layer 1-2 may be formed, for example, by evaporating a metal. In a photoreceptor with this construction, a charging described below is carried out by electrical charge from the side of insulating layer 3*c*. An image exposure and a uniform color light exposure are carried out from the side of the insulating layer 3*a* comprising filter units.

Figure 9:
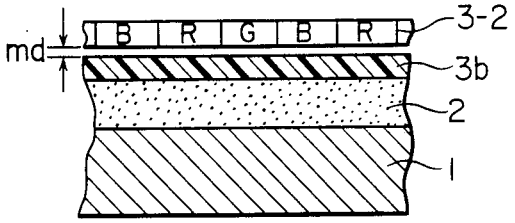

In the case of a drum-shaped photoreceptor, as shown in FIG. 9, the transparent insulating layer 3*b* is formed on the photoconductive layer 2, and then, with a slight space md left from the transparent insulating layer 3*b*, a layer 3-2 (similar to the above-described layer 3*a*) comprising R, G, and B filter units are provided coaxially with the photoreceptor, that is, the cylinder 3-2 consisting of R, G, B filter units is integrally coaxially provided around the the drum-shaped photoreceptor having no filter units. Such a construction permits any filter units shown in FIGS. 10 through 12 to be randomly selected or exchanged from the layers of filter units. The detailed description of the above will be made below. The space md should be slight so that an image on a filter cell is not blurred in a great extent and not projected on an insulating layer or a photoconductive layer. It is not necessary to dispose the filter layer 3-2 on the transparent insulating layer 3*b* with a space left from each other, but both may be in contact relation.

In the filter layer 3*a* to be formed as a result of a colorant and a colored resin being adhered thereto, the configuration and arrangement of finely divided R, G, and B filter units are not specified. However, it is preferable to use filter units in stripe configuration shown in FIG. 10 because such a configuration makes it easy to form a pattern. Filter units in mosaic configuration shown in FIGS. 11 and 12 are also preferable because a reproduction of a delicate multicolor image is possible.

The direction in which R, G, and B filter units in stripe and mosaic configurations may be adjusted to any directions in which a photoreceptor faces, that is, if a photoreceptor is drum-shaped and rotatable, the periodical arrangement direction of l of filter units in mosaic or stripe configuration in FIGS. 11 and 12 may be parallel to, normal to, or diagonal to the axis of the photoreceptor. If the dimensions of R, G, and B filter units are too large, the resolving power and the color reproductivity of a toner image degrade, which in turn lowers the toner image quality. To the contrary, if they are as small as the diameter of toner particles or less than that, filter units exert bad influence or adjacent filter units, and further, it is difficult to form distribution patterns of filter units. Though the situation in which the toner image is formed exerts influence on the toner image formation, it is preferable that the dimension l of filter units ranges from 10 to 100 micrometers since the area of the toner image which adhere to a filter unit of the filter units is greater than that of the filter unit according to the present invention.

Favorably, each filter unit has a high resistance. More favorably, the resistance of each filter unit is more than $10^{13}$ Ωcm. If filter units have low resistances, they are electrically insulated each other by providing gaps or interposing insulators between the filters units.

Figure 13:
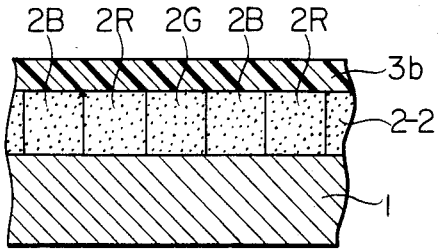
Figure 14:
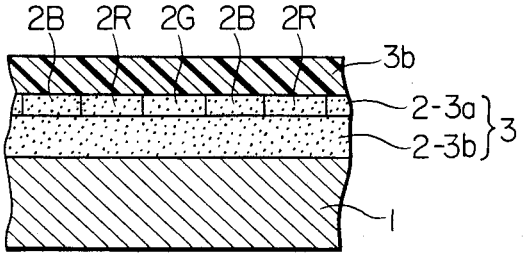

Instead of the layer 3*a* consisting of the filter units as described above, a photoreceptor in which a photoconductive layer has a function of separating colors may be used. FIGS. 13 and 14 show examples of photoreceptors previously proposed by the applicant in Japanese Patent O.P.I. Publication No. 77861/1986 and Japanese Patent Application No. 245177/1985 (corresponding to Japanese Patent O.P.I. Publication No. 105.154/1987). The photoreceptor shown in FIG. 13 comprises a conductive substrate 1, photoconductive layer 2—2 which contains many photoconductive portions 2R, 2G, 2B and is sensitive to red (R), green (G), blue (B), and has a required spectral sensitivity distribution, and a transparent insulating layer 3*b* which is provided on the layer 2—2. The photoreceptor in FIG. 14 comprises a conductive substrate 1, a charge transfer layer 2-3*b* which is on the conductive substrate 1 and a charge generation layer 2-3*a* consisting of photoconductive portions 2B, 2R, and 2G whose spectral sensitivity distributions are different, and a transparent insulating layer 3*b*. In the photoreceptor shown in FIG. 14, a photoconductive layer 2-3 is constructed by a charge generation layer 2-3*a* and a charge transfer layer 2-3*b*. The construction of the the photoconductive layer 2—2 in plan view in FIG. 13 and that of the charge generation layer 2-3*a* in plan view in FIG. 14 may be similar to those shown in FIGS. 10, 11 and 12 as in the case of the insulating layer consisting of the above-described filter units.

The principle of how a multicolor image in the same color as an original image is formed on a photoreceptor having the above-described construction will be illustrated with reference to FIG. 15. In FIG. 15, as the photoconductive layer 2 in the photoreceptor, a photoconductive material consisting of an n-type semiconductor such as cadmium sulfide is used. Like parts are designated by like reference numerals in FIG. 15 and FIGS. 4 through 7.

FIG. 15—(1) shows that the photoreceptor 4 is provided with primary uniform charge by a positive corona discharge of the charger 5. A positive charge is generated on the surface of the insulating layer 3 and a negative charge is induced at the boundary between the photoconductive layer 2 and the insulating layer 3. As a result, the surface of the photoreceptor 4 shows a uniform potential E as shown in the graph.

FIG. 15—(2) shows that the charged surface is imagewise exposed and a secondary charge is provided by a charger 16 simultaneously. In this example, the change in the charged surface of the portion where a red image $L_R$ has been irradiated is shown. The red image $L_R$ passes through the R filter unit in the insulating layer 3, thus causing the photoconductive layer 2 located under the insulating layer 3 to be conductive. Caused by a secondary charge, the charge on the surface of the insulating layer 3 and the negative charge generated at the boundary between the photoconductive layer 2 and the insulating layer 3 disappears. Thereafter, the potential pattern is fully smoothed by a charger 26. Since the G and B filter units do not allow the red image $L_R$ to pass therethrough, the negative charge which has been induced does not disappear at the G and B filter units. The above phenomenon occurs in the case of other color components of an image exposure light. Thus, a latent image is formed correspondingly to each color component at the boundary between the insulating layer 3 and the photoconductive layer 2. It is to be noted, however, that the chargers 16 and 26 of the image exposing unit 6 cause the surface potential of the photoreceptor to be uniform as shown in the graph irrespective of the quantity of the charge which exists at the boundary between the insulating layer 3 and the photoconductive layer 2, namely, irrespective whether or not an image exposure light is provided with the boundary. The same results are obtained in the case of green and blue components of an image exposure light. A state, where an imagewise exposure is made by image exposure unit 6, is a state unified above-mentioned results. Therefore, no functional charged image is formed as far as the states remain unchanged.

FIG. 15—(3) shows the condition under which the above-described exposed surface is uniformly exposed by blue light $L_B$ irradiated from a lamp 7B. Since the R and G filter units do not allow the blue light $L_B$ to pass therethrough, the face is not electrically influenced by the blue light $L_B$. However, the blue light $L_B$ passes through the B filter units so as to make the photoconductive layer 2 thereunder conductive, so that the charge existing at the upper and lower surfaces of the layer 2 is neutralized. As a result, a potential pattern which gives a blue complementary image of previously exposed light appears on the surface of the insulating layer 3 corresponding to the B filter units.

In FIG. 15—(4), a potential pattern formed by a uniform exposure by the blue light $L_B$ is developed by a developing unit 8Y which accommodates yellow toner TY which has been negatively charged. The yellow toner TY adheres to only the B filter units where the potential has been changed by the uniform image exposure, but not to R and G filter units where the potential has not been changed. As a result, a yellow toner image corresponding to one of the separated colors is formed on the surface of the photoreceptor 4. At the B filter units where the yellow toner TY has adhered, the potential lowers a little as a result of the development, and the surface potential is still unchanged.

In FIG. 15—(5), a corona discharge is carried out with a charger 9Y on the surface of the photoreceptor 4 where the yellow toner image has been formed. The corona discharge with the charger 9Y lowers the potential of the B filter unit where the yellow toner TY has adhered, thereby making the surface potential uniform. The surface potential of the photoreceptor 4 is shown in a graph.

Next, the surface of the photoreceptor 4 shown in FIG. 15 (5) where the yellow toner image has been formed is exposed uniformly by green light emitted from a lamp 7G, thereby a potential pattern appearing at the G filter units similarly to FIG. 15—(3).

As a result of the development of this potential pattern with a developing unit which accommodates magenta toner, the magneta toner adheres to only the G filter units, thereby a magenta toner image being formed in the manner similar to that described in FIG. 15—(4). Thus, a toner image in two colors is formed on the photoreceptor 4. Thereafter, a corona discharge is carried out on this image-formed surface in the same manner as that shown in FIG. 15—(5) by a charger so as to make the surface potential uniform. These processes are shown in FIG. 15—(6), (7), and (8).

Next, the photoreceptor 4 where the toner image in two colors has been formed is uniformly exposed by red light emitted from a lamp 7R. As a result, in the manner similar to that described in FIG. 15—(3), a potential pattern appears on the R filter units and the generated potential pattern is developed by a developing unit which accommodates cyan toner so as to form a cyan toner image. In this case, since the toner image is red, a potential pattern is not formed and the cyan toner does not adhere to the R filter units. Thus, a red image is reproduced from the yellow toner and magenta toner.

As a result of the above-described process, a color image having neither color doublings nor color stains is formed on the photoreceptor 4.

The method of forming an original image by means of yellow, magenta, and cyan toners utilizing the three color separating method to be thus performed is summarised in Table 1 below.

In Table 1, the symbol "◌" indicates that an image pattern is formed according to the difference of charge density generated at the boundary between the insulating layer 3 and the photoconductive layer 2 in the photoreceptor. The symbol " O " indicates that an image-like potential pattern appears on the surface of the photoreceptor. The symbol " ● " indicates that a toner image is formed. The symbol " ↓ " indicates that image exposure state is maintained. The blanks show that no image is formed. "—" in "Adhered toner" column indicates that no toner adheres to filter units and Y, M, and C indicate that yellow, magenta, and cyanogen toners adhere to the corresponding filter units.

The photoconductive layer 2 of the photoreceptor 4 shown in FIG. 15 is composed of an n-type semiconductor. However, the same image forming process is employed if a p-type semiconductor consisting of selenium and the like serving as the photoconductive layer 2 is used except that all of the signs of charge shown in FIG. 15 are reversed. If it is difficult to inject charge for charging of photoreceptor 4, a uniform irradiation may be performed simultaneously or immediately before or after charging.

As apparent from FIG. 15 and Table 1, the reproduction of the color of an original image by means of this image forming method is performed by forming a potential pattern on a filter unit which does not allow the color component of a light transmitted from the original image to pass therethrough so as to make the potential pattern a latent image, and thereafter, by developing the latent image thus generated with toners in the three primary colors. Thus, a color change is possible by selecting a combination of a uniform exposure light by which the above-described potential pattern is formed and a development to be carried out.

A toner image to be obtained thus adheres to the corresponding filter unit. In this case, an image density can be improved to a certain extent by arranging a transfer fixation condition. However, a preferable improvement of the image density cannot be made according to the method described above.

The reason an image density is unsatisfactory according to this method is because an image forming is performed by additive color process.

The present invention has been developed to solve the above-described problem. According to the invention, the area of toners which adhere to a filter unit of the filter units is greater than that of the filter unit provided in the photoreceptor, whereby toners in different colors are mixed, and an image density is improved and an original image can be favorably reproduced.

Figure 2:
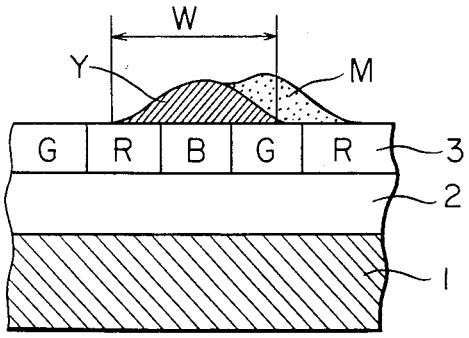
FIG. 2 is a view showing toners which adheres to a photoreceptor.
Figure 3:
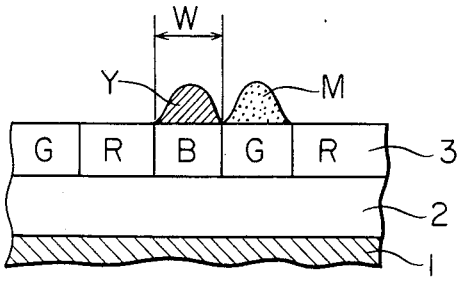
FIG. 3 is a view showing toners which adhere to photoreceptor according to a conventional method.

FIG. 2 shows a shape of toners which adhere to a photoreceptor according to the present invention. FIG. 3 shows the conventional shape of toners which adhere to a photoreceptor. These drawings show toners which adhere to high density portions of an original image. It is preferable that the area of toners which adhere to a filter unit is greater than that of the filter unit and that toners do not spread beyond neighboring filter units in the same color as the filter unit of their resolving power. Favorably, the area of toners which adhere to a filter unit ranges from 1.0 to 10 times as great as that of the filter unit. More favorably, it ranges from 1.1 to 6.0 times as great as that of the filter unit considering image density and resolving power. Vividness and gradation are also favorable in this range. The potential contrast

TABLE 1

| Original image color | White | | | Red | | | Green | | | Blue | | | Yellow | | | Magenta | | | Cyan | | | Black | | |
|---|---|---|---|---|---|---|---|---|---|---|---|---|---|---|---|---|---|---|---|---|---|---|---|---|
| Insulating layer filter | R | G | B | R | G | B | R | G | B | R | G | B | R | G | B | R | G | B | R | G | B | R | G | B |
| Image exposure | | | | | ◌ | ◌ | ◌ | | ◌ | ◌ | ◌ | | | | ◌ | | ◌ | | ◌ | | | ◌ | ◌ | ◌ |
| Uniform exposure by blue | | | | | ↓ | O | ↓ | | O | ↓ | ↓ | | | | O | | ↓ | | ↓ | | | ↓ | ↓ | O |
| Yellow development | | | | | ↓ | O | ↓ | | O | ↓ | ↓ | | | | O | | ↓ | | ↓ | | | ↓ | ↓ | O |
| Uniform charge | | | | | ↓ | | ↓ | | | ↓ | ↓ | | | | | | ↓ | | ↓ | | | ↓ | ↓ | |
| Uniform exposure by green | | | | | O | | ↓ | | | ↓ | O | | | | | | O | | ↓ | | | ↓ | O | |
| Magenta development | | | | | O | | ↓ | | | ↓ | O | | | | | | O | | ↓ | | | ↓ | O | |
| Uniform charge | | | | | | | ↓ | | | ↓ | | | | | | | | | ↓ | | | ↓ | | |
| Uniform exposure by red | | | | | | | O | | | O | | | | | | | | | O | | | O | | |
| Cyan development | | | | | | | O | | | O | | | | | | | | | O | | | O | | |
| Adhere toner | — | — | — | — | M | Y | C | — | Y | C | M | — | — | — | Y | — | M | — | C | — | — | C | M | Y |
| Reproduced color | White | | | Red | | | Green | | | Blue | | | Yellow | | | Magenta | | | Cyan | | | Black | | |

of toners is small in the area whose density is similar to the white portion of an original image, so that the area which the toners spread from the filter units is small or toners adhere only the inside of the filter units. This is the reason why the vividness and gradation of the color image are favorable in this range.

Such a favorable adhering performance of toners is effected by carrying out the following methods.

(1) The potential contrast of the image portion of a photoreceptor is large.

Toners adhere to a filter unit in large quantities where an image has been formed when the potential contrast of an image is large, so that the toners can spread over neighboring filter units. In order to accomplish this, it is preferable that potential contrast ranges from 500 V to 1500 V.

The potential contrast herein is defined as the difference between the potential formed on a photoreceptor when a secondary charge is provided without providing an exposure after a primary charge is provided thereto and the surface potential of the photoreceptor when a secondary charge is provided thereto while the photoreceptor is being exposed enough by white color. The surface potential of the photoreceptor can be measured by an electrometer known in the art.

(2) Design of Photo-resistor

The configuration of electric lines of force to be formed at each filter unit of a photoreceptor is determined by size of filter unit, the thickness of a photosensitive layer, dielectric constant, and electrode efficiency of an insulating layer.

Filter size is the most efficient of all of the above factors for favorably realizing the adherence of toners according to the present invention. Toners spread and adhere to adjacently located filter units by reducing the dimensions of filter units. The favorable filter size l ranges from 10 to 100 μm.

The thinner the thickness of an insulating layer is, the larger a potential contrast is. Accordingly, the favorable thickness of an insulating layer ranges from 5 to 5 μm. More favorably, it ranges from 5 to 30 μm.

The stronger an electrode effect is, the more favorable the resolving power is when a development is carried out. If electrode effect is weak, the adherence performance of toners is reduced. Therefore, preferably, the gap between a photoreceptor and a developing sleeve ranges from 0.1 mm to 1.0 mm. By providing this gap, a strong electrode effect can be obtained and the adherence performance of the toners increases in this range.

(3) Developing Condition

As developing condtions, electrode effect, development bias, and toner particle diameter are considered. It is preferable that the development bias is so strong as not to destroy a formed toner image. Preferably, a two component developer is used because color toner is used in a development.

When an average particle diameter of toners is large, toners which have adhered to a filter unit diffuse to filter unit in other colors. In this case, generated roughness is conspicuous in an image. Toners whose average diameter is approximately 20 μm can be used to develop the toners having a high resolving power when filter units whose pitch l in plan view is less than 100 micrometers. The use of toners whose average diameters are less than 10 micrometers improves resolving power drastically, i.e., when the color of an original image is reproduced favorably by using a filter unit whose pitch in plan view is less than 100 micrometers, a toner image of high quality is obtained. Thus, the favorable particle diameter of toners is less than 20 μm. More favorably, it is less than 10 μm. Toners whose average charge quantity is more than 1–3 μc/g are effectively used in oscillation electric field. More favorably, it is in the range from 3 to 300 μc/g. When particle diameter of toners is small, a high charge quantity is required.

The toners as described above can be obtained by the method similar to the conventional methods, i.e., the toner to be used according to the present invention is obtained by selecting conventional spherical toners, non-spherical magnetic or non-magnetic toners using an average particle diameter-selecting means. Of the above toners, toners containing magnetic particles are preferable. It is preferable that the weight percentage of fine magnetic particles is less than 60. Magnetic toners are subjected to the influence of the magnetic poles N and S of a magnet such as shown in FIG. 9, so that the uniformity of toners are improved and the toners are prevented from being scattered, and the generation of a fog is also prevented. If magnetic material is contained too much in toners, the magnetic force between the toners and carrier particles becomes too large, with the result that a favorable density canot be obtained. Further, magnetic fine particles appear on the surface of the toner particles. As a result, it becomes difficult to control triboelectrification and the destruction of the toner particles may occur, and the aggregation with carrier particles may also occur. A vivid color cannot be reproduced by color toners except black and brown unless the quantity of magnetic material is less than 30 wt %.

Summarizing the above, a preferable toner is formed by using resins such as styrene class, vinyl class, ethylene class, denaturated rosin, acrylic class, polyamide, epoxy, polyester. A mixture of magnetic fine particles and colorants such as carbon is also used. A charge controlling agent may also be added to the mixture as necessary. Such toners are formed by the method similar to the conventional method of manufacturing toner particles. The favorable average diameter of the toner particles to be formed is less than 20 micrometers. More favorably, it is less than 10 micrometers. The toner particles spherically formed by means of spray drying method, or after they are manufactured, improve the flowing performance of developers, i.e., the aggregation of developing agents is prevented and the toner particles mix with carrier particles uniformly and are easily transported and charged.

When the average diameter of magnetic carriers is large, the following problems occur.

(1) developers to be formed on the developing sleeve 2 become rough, so that a developed latent image with oscillation applied thereto in an oscillation electric field gives rise to a blur in a toner image.

(2) toner density in a developer becomes low, so that a toner image cannot be developed in a high density.

Experiments show that the occurrence of the disadvantages as described above are reduced by using magnetic carriers whose average diameter is small. The average diameter of magnetic carriers used in the experiments is less than 50 micrometers. The disadvantages can be solved by magnetic carriers whose average diameter is less than 30 micrometers. When carrier particles are too small in the average diameter, the following problems occur:

(3) A mixture of carrier particles and toner particles adhere to the surface of the photoreceptor.

(4) carrier particles are easily scattered. These phenomena occur when the average diameter of carrier particles is less than 15 micrometers and is conspicuous when it is less than five micrometers. These phenomena are of course related to the degree of the intensity of magnetic field which acts on carrier particles and the degree of magnetization of the carrier particles. Part of the carrier particles which have adhered to the surface of the photoreceptor are transferred to a recording sheet with the toner particles mixed therewith. The remaining carrier particles are removed from the surface of the photoreceptor with a cleaning unit such as a blade or a fur brush, when the remaining toner particles are also removed therefrom. Conventional carrier particles consisting of only magnetic material have the following disadvantages:

(5) carrier particles which have transferred to a recording sheet are not fixed to the recording sheet. Therefore, the carrier particles may fall off the recording sheet.

(6) when carrier particles which have not been removed from the surface of the photoreceptor are removed with a cleaning unit, they may damage the surface of the photoreceptor. The problems of (5) and (6) can be solved by forming carrier particles integrally with a substance which can fix magnetic carrier particles to a recording sheet consisting of resin, i.e., magnetic particles are coated with substances which can fix magnetic carrier particles to the recording sheet or they are formed by a substance which can fix magnetic particles to the recording sheet containing magnetic particles which are dispersed therein, whereby carrier particles which have adhered to the recording sheet can be fixed thereto by heat and pressure and carrier particles do not damage the surface of the photoreceptor when they are removed therefrom with a cleaning unit. When the average diameter of such carrier particles ranges from 5 to 15 micrometers, the phenomenon described in (3) above does not occur if the carrier particles are transferred to the surface of the photoreceptor or the recording sheet.

The preferable average particle diameter of magnetic carrier particles is less than 50 micrometers. More favorably, it ranges from 5 to 30 micrometers. It is also preferable that the magnetic carrier particles contain substance which can fix them to a recording sheet. The above-described average particle diameter are, as in the case of toner particles, weight average. It is measured with a Coulter counter manufactured by Coulter Corp or an Omnin-Alpha manufacured by Bausch & Lomb Corp.

The above-described magnetic carrier is obtained by selecting the following particle from conventional particles having strong or normal magnetic intensity, namely, metals, for example, iron, chrome, nickel, cobalt, or compounds thereof, alloys, for example, triiron tetraoxide, gamma-ferric oxide, chromium dioxide, manganous oxide, ferrite, manganese-alloy of copper group; particles whose surface are coated with such resins as described previously to be contained in toners; particles whose surfaces are coated with waxes consisting of fatty acids such as palmitic acid, stearic acid or the like; or fatty acids such as palmitic acid, stearic acid or the like; or particles consisting of resins which contain magnetic particles which are dispersed therein or waxes consisting of fatty acids. The selection of a particle diameter is made with conventional average particle selecting means.

Carrier particles formed by resins or the like and preferably in spherical shape make, in addition to the above-described efficiency, a developer layer to be formed on the developing sleeve uniform and permits an application of a high bias voltage to the developing sleeve. More specifically, carrier particles composed of resins are effective in that (1) the carrier particles are not magnetically absoborbed in a major axis, and as such, a developer layer is formed uniformly, and the generation of regions where resistance is low and the generation of non-uniformity of the developer layer are prevented; (2) there are no such edged portions as found in conventional carriers particles because the carrier particles have a high resistance, so that no concentration of electric field to the edges portions occur. Accordingly, when a high bias voltage is applied to the developing sleeve, an electric discharge does not occur in the image forming material 1, so that a latent image is neither disturbed nor a breakdown of the bias voltage occurs. The application of the high bias voltage brings about an efficiency when a development is carried out under an osillation electric field according to the present invention.

A wax is contained in carrier particles which produce the above-described efficiency. However, carriers containing the above-described resins are more favorable in order to make carriers durable. It is preferable that a carrier contains magnetic particles having an insulation performance and that the carrier particles thus formed have resistivity more thatn $10^8$ Ωcm. More favorable resistivity is more than $10^{13}$ Ωcm. These resistivities are electric current values measured by the following method, that is, first, carrier particles are put in a container whose sectional area is 0.50 $cm^2$, and then, tapped. After applying a load of 1 $kg/cm^2$ to the carrier particles, a voltage which generates an electric field of 1000 V/cm is applied to a gap between the load and a base electrode. When a bias voltage is applied to the developing sleeve, an electric charge is injected to carrier particles whose resistivity is low, in which case, carrier particles adhere to the image forming material 1 or a breakdown of bias voltage occurs.

As described above, besides the average particle diameter, the requirements for magnetic carrier particles are that they are spherical such that the ratio of their major axes to minor axes is less than three, that is, they have no protruded or edges portions and that the resistivity is more than $10^8$ Ωcm and more favorably, it is more than $10^{13}$ Ωcm. Spherical magnetic carrier particles and carriers coated with resins having high resistivities are manufactured by coating them with resins. Carriers in which magnetic fine particles are dispersed are manufactured by sphering fine magnetic particles or by means of spray drying method after forming such particles using magnetic fine particles as many as possible.

The preferable developing agents for use in a developing unit according to the present invention consist of toners and magnetic carrier mixed with each other at the same ratio as that in conventional two component developer. In carrying out a non-contact development, a developer containing toners at the percentage as high as 10 to 80 is employed.

A flowing agent and a cleaning agent are contained in a developer as necessary. The former is to improve the flowing performance of carrier particles. The latter is to clean the surface of the photoreceptor. Flowing agents and cleaning agents include surface active agents such as colloidal silica, silicone varnish, metallic soap, non-ionic surface active agent, silicone in which organic groups have been substituted, and fluorine surface active agent.

The following description is concerned with the developing requirements for forming a developer layer with such developers so as to develop an electrostatic latent image on the photoreceptor.

Shown in FIG. 19 is a sectional view of a developing device. In the device, the gap between a developing sleeve 81 and the photoreceptor 4 is preferably in the range from 10 to 100 micrometers in order to increase the quantity and area of toners which adhere to a filter unit. The gap less than 10 micrometers makes it difficult to form a developer layer which has a function of developing toners uniformly and impossible to provide enough quantity of toners with a developing region, thus causing unstable developments. To the contrary, when the gap is over 100 micrometers, the quantity of toners which adhere to a filter unit is reduced, so that it is difficult to make the area to which toners adhere larger than that of the filter unit, and as such, a favorable developing density cannot be obtained by means of a color mixture. It is therefore preferable that the gap and the thickness of the developing agent layer are set such that the developer layer does not contact with the surface of the photoreceptor 4 and yet both are as close as possible to the latter under the condition in which an oscillating electric field is not generated when a non-image is being formed. By thus setting the gap and the thickness of the developer layer, the generation of a brushing mark-like defect or a fog is prevented in a toner image. It is preferable to place the position where the developing sleeve 81 approaches the photoreceptor 4 such that the force of gravity is in the direction toward the developing sleeve 81 in order to prevent toners from splashing around. However, it is not limited to this direction. Preferably, the rotation speed of the developing sleeve 81 is slow and the rotation direction is opposite to that in which the photoreceptor 4 rotates so that toners are prevented from splashing around. However, it is preferable that the rotation direction of the former is the same as that in which the latter rotates and the rotation speed of the former is almost the same as that in which the latter rotates or faster than the speed with which the latter rotates in order to obtain a favorable image reproduction by a developer layer.

It is therefore preferable not to allow the circumferential speed of the developing sleeve 81 beyond four to five times as fast as that of the photoreceptor 4 and to set the rotation direction of the former to be the same as that which the latter rotates. However, it is not limited to this direction.

As fixed magnets, those disclosed in Japanese Patent O.P.I. Publication Nos. 176069/1985 and 131553/1985 are preferably used.

The magnetic roller 82 to be provided in the developing sleeve 81 is rotatable in the same direction as or opposite to the direction in which the developing sleeve 81 rotates. The magnetic roller 82 disclosed in Japanese Patent O.P.I. Publication No. 131552/1985 may be favorably utilized.

A development in an oscillating electric field is preferably carried out by applying a bias voltage, which is generated by superimposing direct-current voltage which is related to the prevention of a fog generation and the alternating voltage related to density and gradation of the developed images, to the developing sleeve 81 by means of bias power source 80 so as to generate an oscillation electric field in a developing field. Preferably, the direct-current component approximately equals to the voltage of the potential of the non-image portion of the photoreceptor or is higher than that, namely, 50 to 600 V. As an alternating current component, a favorable frequency is favorably wihin the range of from 1 to 5 KHz. The amplitude is favorably, in the range from 100 to 5000 V. The direct-current component is allowed to be lower than that of the non-image portion when toners are magnetic toners. If the frequency of an alternating current component is too low, oscillation pitches appear on a developed toner image. If it is too high, a developer cannot follow the oscillation of an electric field, with the result that development density is lowered and the reproduction of a vivid image cannot be obtained. In addition to frequency, the amplitude of an alternating current component is related to improving a development efficiency, that is, the larger the amplitude is, the more a developer layer is oscillated and the more a fog occurs and the destruction of an insulation layer such as an arcing development occur. Carrier particles in a developing agent which are insulated by resins and sphered prevent an insulating layer from being destroyed and a fog from being generated by a direct-current component. The surface of a developing sleeve 81 may be insulated or half-insulated with resins or oxide layers. The developing sleeve 81 with which convexes and concaves are provided preferably carries a developer layer.

According to a developing device of the present invention, an original image can be developed vividly by using the above-described developer under such a condition as described above, that is, a development can be carried out stably without generating a fog and with a superior resolving power maintained. According to the invention, an oscillating electric field can be generated not only by applying an oscillation voltage to the developing sleeve 81, but also by providing several electrode wires at the interval of 100 to 2000 micrometers or electrode nets having openings whose dimensions ranges from 100 to 2000 micrometers in the periphery of a development area between the developing sleeve 81 and the photoreceptor 4. Thus, toners are prevented from being splashed around. In this case, a direct-current bias voltage is applied onto the developing sleeve 81 or an oscillation voltage having a different frequency is applied thereto.

According to the present invention, each filter unit of a photoreceptor is adhered by a toner whose color is complementary for the color of a light which passes through the filter unit. Accordingly, if toners which have adhered to the filter unit adhere to and spread over neighboring filter units, a light which permeates through the neighboring filter can permeate therethrough because the light is not in the complementary relation to the toners which have spread over the neighboring filter. Accordingly, a potential pattern can be generated by the light in the filter unit when an original image is uniformly exposed. Toners which absorb or reflect part of a uniform image exposure light can be used stably provided that the toners can generate a potential pattern in the filter unit. A uniform image exposure light can be irradiated in such a proper quantity to a filter as not to generate a potential pattern which may cause any problems with other filter units. Part of the uniform image exposure light irradiated to a filter permeates through other filters. Therefore, it is preferable to reduce the quantity of the whole image exposure light to the minimum.

A multicolor image forming device shown in FIG. 1 forms an image according to the above-described principle. While a drum-shaped photoreceptor 4 is making one rotation in the direction shown by an arrow, a multicolor image is formed. More specifically, the charger 5 charges the surface of the photorecepter 4 uniformly. While an image exposure unit 6 is exposing an image on the charged surface by a white light emitted from a halogen light and reflected from an original image, the photoreceptor 4 is almost uniformly charged by a charger 16 which carries out an alternating current corona discharge or a direct-current corona discharge of signs opposite to those of the charger 5. Next, the surface potential of the photoreceptor 4 is made completely uniform by a charger 26 having a construction similar to the charger 16. It is possible to mount the charger 26 adjacent to and at the downstream side of the charger 16 of the image exposure unit 6 so as to integrate the charger 26 with the charger 16.

Thereafter, a blue light $L_B$ emitted from a lamp $7_B$ is uniformly irradiated to the image-exposed surface. As a result, a potential pattern which gives a blue complementary image appears on the image-exposed surface. The potential pattern is developed by a developing unit 8Y which accommodates yellow toners. Thereafter, the surface of the photoreceptor 4 is uniformly charged by a charger 9Y which carries out a corona discharge similar to that carried out by the charger 16. Next, green light emitted from a lamp 7G is uniformly irradiated to the surface of the photoreceptor 4 to form a potential pattern which gives a green complementary image, and then, the potentail pattern is developed by a developing unit 8M, which accomodates magenta toners, with the result that a toner image in two colors is formed on the surface of the photoreceptor 4. Thereafter, the discharge of a charger 9M having the same function and construction as the charger 9Y, a uniform irradiation of red light $L_R$ emitted from a lamp 7R, and the development by a developing unit 8C which accommodates cyan toners are effected. Thus, superimposed toner images in yellow, magenta, and cyan are formed.

In order to give a crispness to the toner image, an exposure light comprising either a white light, infrared light, red light or a light comprising green and red light is imparted from a lamp 7K to a filter unit to which toners have adhered. Thereafter, utilizing a potential pattern which has been generated in a little quantity, the charged portion of respective filter units are developed by means of a developing unit 8K using black toners, thereby a more favorable image being obtained. The reason a blue light is not used as an exposure light is to prevent impurifying a color which may be caused by the adherence of black toner to the brightest yellow toner.

A multicolor toner image thus formed passes a developing unit 8K which accommodates black toners and has been stopped from operating. At this point, the multicolor toner image is not devloped. Thereafter, a charge is imparted to the toner by a pre-transfer charger 14 so that the toner image may be easily transferred to a recording paper P fed from a paper feeding unit 15 by a transfer unit 10. The recording sheet p to which the multicolor toner image has been transferred is separated from the photoreceptor 4 by a separator 11, and then, fed to a fixing unit 18 by a transfer means 17. Thereafter, the multicolor toner image is fixed to the recording sheet P, and then, discharged outside the device. The surface of the photoreceptor 4 which has been transferred to the multicolor toner image is neutralized by a neutralizer 12 which carries out an exposure and discharge and toner which has remained on the surface of the photoreceptor 4 is removed by a cleaning unit 13 so that the next image formation may be effected.

In the above-described multicolor image forming process, the colors to be used for a uniform exosure light are not necessarily B, G, and R. In a filter unit of a photoreceptor 4 through which uniform exposure light has passed, the charge which existed between an insulating layer and the photoconductive layer has already disappeared. Therefore, the change of the potential to be generated on the surface of the photoreceptor is slight when a light passes therethrough again. Accordingly, when a uniform exposure is carried out in the order of red, yellow, and white lights and a toner image is developed in the order of cyan, magenta, and yellow toners, a multicolor image whose original colors are favorably reproduced can be obtained. A uniform exposure can be carried out as well by a light of spectral distribution. As described above, when a light for a uniform exposure passes through a filter unit on a photoreceptor more than once, it is preferable to irradiate the minimum quantity of light like the case of carrying out a uniform image exposure light so that a charge at the boundary between an insulating layer and a photoconductive layer may be completely eliminated. Thus, a light to be used as a uniform exposure forms a potential pattern on a filter unit corresponding to the color of the light. This has been disclosed in Japanese Patent O.P.I. Publication No. 75368/1986.

A multicolor forming device shown in FIG. 17 is different from that shown in FIG. 1 in that a toner image in a color is formed during one rotation of the photoreceptor 4.

The uniform exposure devices in FIGS. 1 and 17 may be adapted to carry out a uniform exposure by means of specified colors selected by a uniform exposure lamp 7 provided with white light source 7l, filters $F_B$, $F_G$, and $F_R$ to be used by replacing a shutter 7S shown in FIG. 18.

In the multicolor image forming device, in the same manner as the multicolor image forming device in FIG. 1, the same image forming operation as that described with reference to FIG. 15 and Table 1 is carried out. According to this device, a multicolor image having no color doubling and a monochrome image superior in image density and resolving power can be formed. For example, when a three color image is formed, the photoreceptor 4 is charged by the charger 5 and an exposure is carried out by a charger 16, and the surface of the photoreceptor 4 is uniformly charged. Thereafter, a uniform exposure is carried out on the surface of the photoreceptor 4 by a light, emitted from the lamp 7, which has passed through the blue filter unit $F_B$, and then, a potential pattern formed thus is developed by the developing unit 8Y so as to form a yellow toner image. The yellow toner image thus formed rotates around the photoreceptor 4 without being subjected to the influences of developing units 8M, 8C, 8K, the pre-transfer charger 14, a transferring unit 10, a separating unit 11, the cleaning unit 13, and the charger 5. The surface of the photoreceptor 4 on which a toner image has been formed is not irradiated by the charger 16, but subjected to a corona discharge, thereby being made uniform when the photoreceptor 4 reaches the charger 16. Thereafter, the photoreceptor 4 is subjected to a uniform exposure light transmitted from the lamp 7 and the green filter unit $F_G$. Thus, a potential pattern is formed. Following this formation, the potential pattern is developed by the developing unit 8M, so that a magenta toner image is formed. In the same manner as the above, a potential pattern is formed by a light which has passed through the red filter unit $F_R$ and the potential pattern is developed by the developing unit 8C. Thus, a three-color toner image is formed.

The construction of this multicolor image forming device is as simple as that of a monochrome copying machine except that the former is with more developing units than a monochrome copying machine. A monochrome image is formed by this kind of machine of a small size and at a low cost and without reducing copying speed.

Preferably, a magnetic brush-developing device shown in FIG. 19 is used for developing units 8Y, 8M, 8C, and 8K equipped with multicolor image forming devices shown in FIGS. 1 and 17.

In the developing device shown in FIG. 19, either a developing sleeve 81 or a magnet 82 having N and S magnetic poles on the inner circumference of the magnetic sleeve 81 rotates. Thus, the magnetic force of the magnet 82 feeds a developer absorbed from a developer storing place 83 to the surface of the developing sleeve 81 in the direction shown by the arrow. The amount of the developer to be transferred is controlled by a layer thickness control plate 84 while the developer is being transferred to form a predetermined developing layer. A development is carried out according to a potential pattern of the photoreceptor 4 at the region where the developer which has adhered to the developing sleeve 81 confronts the photoreceptor 4. In carrying out the development, a developing bias voltage is applied to the developing sleeve 81 by a bias power source 80. Even if a development is not carried out, the bias voltage may be applied to the developing sleeve 81 in order to prevent toners from being transferred from the developing sleeve 81 to the photoreceptor 4 or vice versa.

While a latent image is being developed by a developing unit 8Y by operating only the developing unit for yellow toner, the developing units 8M, 8C, and 8K shown in FIGS. 1 and 17 are not operated. This non-operation state is maintained by cutting the developing sleeve 81 off the bias power source 80, grounding the bias power source 80 or applying only a direct-current bias voltage having the polarity same as or opposite to the polarity of toners. It is most favorable to apply an alternating bias voltage whose polarity is opposite to that of the toners. Since the developing units 8M, 8C, and 8K carry out a development by non-contact jumping developing method, it is unnecessary to eliminate developer layer on the developing sleeve 81. Developing units which are not used may be stopped during this period of time. It is also effective for preventing the transfer of a developer from the developing sleeve 81 to the photoreceptor 4 or vice versa to remove the developing units from the photoreceptor 4 or to eliminate the developer from the developing sleeve. Numeral 85 indicates a cleaning plate for returning a developer layer which has passed a developing region to the developer storing place 83 by eliminating the developer from the developing sleeve 81. Numeral 86 indicates a stirring means for stirring a developer stored in the developer storing place 83 to make it uniform and tribo-charging the toners. Numeral 88 shows a toner supplying roller for supplying toners from a toner hopper 87 to the developer storing place 83.

The developers to be used in such developing devices as described above may be a one component developer consisting of only toners or a two component developer consisting of toners and magnetic carriers. In carrying out a development, the surface of the photoreceptor 4 may be rubbed with a developer layer, namely, a magnetic brush. However, it is preferable to use developing methods of not allowing a developer layer to come in contact with the surface of the photoreceptor 4, whereby a formed toner image is not damaged in a development to be carried out after a first development is performed. These methods have been disclosed in U.S. Pat. No. 3,893,418, Japanese Pat. O.P.I. publication Nos. 18656/1980, Those disclosed in 181362/1984, 129760/1985, 129764/1985 are very effective for not permitting a developer layer to contact with the surface of the photoreceptor. As methods of superimposing a toner image on a latent image, those disclosed in Japanese Pat. O.P.I. publication Nos. 18976/1986 and 18977/1986 are perferably utilized. These methods use a one component or two component developer containing non-magnetic toners in various colors. According to these methods, an alternating electric field is formed and a development is carried out without allowing a latent image supporting material to come in contact with a developer layer. The non-contact development is performed by setting the dimension of the gap between a developing sleeve and the surface of a photoreceptor to be larger than the thickness of a developer layer on the developing sleeve. This setting is performed provided that there is no potential difference between the developing sleeve and the photoreceptor. A development is carried out, of course, under such conditions as described above.

The color toners to be used for a development are toners for electrostatic development manufactured using a technique known in the art, i.e., the toners consist of colorants of chromatic or achromatic color such as binding resins, organic or inorganic pigments, dyes and various kinds of magnetic additives known in the art. The carriers to be used for a development include a carrier consisting of iron powder and ferrite used for forming a latent image and resins which coat the the mixture of iron powder and ferrite or magnetic carrier in which magnetic materials are dispersed in resins known in the art. In addition to the above-described developing methods, the developing methods disclosed in the specifications of Japanese Pat. O.P.I. publication Nos. 140362/1985 and 131549/1985 whose application was filed with the Japanese Patent Office by the present applicant may be utilized. The condition described above in "(3) Developing condition" is very effective for performing the method according to the present invention.

EXAMPLE

The photoreceptor 4 provided with the multicolor image forming device shown in FIG. 1 is composed of a conductive layer, a photoconductive layer consisting of Se-Te whose thickness is 40 micrometers, red, green, and blue filter units arranged on the photoconductive layer in mosaic configuration whose length l is 50 micrometers, and an insulating layer whose thickness is 15 micrometers. The outer diameter of the photoreceptor 4 is 180 mm and the photoreceptor 4 rotates 100 mm/sec in surface speed. The developing units 8Y, 8M, 8C, and 8K have the construction shown in FIG. 19. The developing sleeve 81 comprises non-magnetic stainless steel and its outer diameter is 20 mm. Its rotation speed during a development is 140 mm/sec in surface speed. The rotation direction is shown by an arrow. The magnet 82 has four N and S magnetic poles, respectively and imparts a maximum of 800 G magnetic flux density to the surface of the developing sleeve 81. It rotates at 600 rpm in the direction shown by an arrow. The gap between the photoreceptor 4 and the surface of the developing sleeve 81 is the same, namely, 0.75 mm in each of the developing units 8Y, 8M, 8C, and 8K. A developer layer whose thickness is 0.5 mm is formed on the developing sleeve 81. The developer consists of toners whose average particle diameter is 5 micrometers and triboelectrified to $+10-+30$ $\mu c/g$ and carriers consisting of a resin in which magnetic material is dispersingly contained. The average particle diameter of the carriers is 25 micrometers and the resistivity of the carriers is more than $10^{13}$ $\Omega$cm. The mixture ratio of the toners to the carrier is one to nine in weight ratio. The colors of the toners are yellow, magenta, cyanogen, and black each for the developing units 8Y, 8M, 8C, and 8K. A Scotron discharger was used as the charger 5. The Scotron dischargers were used as the chargers 16, 26, 9Y, 9M, and 9C. A discharge voltage which sets the surface potential of the photoreceptor 4 to be $-1.5$ Kv was applied to the charger 5. A discharge voltage which sets the surface potential of the discharger 26, the charger 9Y, 9M, 9C to be $+500$ was applied thereto after a second charge was carried out. When a development is carried out by the developing units 8Y, 8M, 8C, a developing bias voltage was applied to the developing sleeve 81. The developing bias voltage applied to the sleeve 81 comprises a direct-current voltage of $+400$ V and an alternating voltage whose effective value is 0.5 Kv and frequency is 2 KHz, superimposed on the direct-current voltage. When a development was carried out by the developing unit 8K, a developing bias voltage was applied to the developing sleeve 81. The developing bias voltage comprises a direct-current voltage of $+200$ V and an alternating voltage whose effective value is 1.2 Kv and frequency is 2 KHz, superimposed on the direct-current voltage. The surface potential of the photoreceptor in each of the processes for forming an image was shown by the graph in FIG. 16 when the multicolor image forming device was operated. As shown in FIG. 16, the surface potential of the photoreceptor was $-1500$ V as a result of applying a primary charge and $+500$ V as a result of providing a second charge. The potential of the image portion, namely, the portion to which toners adhere was approximately $+100$ V as a result of uniform exposure of blue, green, and red lights. The potential of non-image portion did not change and a latent image whose surface potential was different from that of the non-image portion by approximately 400 V was formed. This potential, namely, the average potential of the surface of the photoreceptor was measured by a surface potential-measuring meter. When the surface of the photoreceptor was irradiated by red, green or blue light, a charge was generated from a filter unit in the same color as an irradiated light, i.e., the charge was generated from $\frac{1}{3}$ of the whole area of the surface of the photoreceptor. It is understood from this that the potential contrast of an image generated in a filter unit is three times as large as the surface potential of the above-described image portion, namely, approximately 1200 V. This is easily understood from the fact that the generated surface potential was $-700$ V as shown by the curve w in the graph, i.e., the potential contrast of 1200 V was generated between the image area and the non-image area when a uniform exposure was carried out by white light after a secondary charge was carried out so as to generate a charge on the entire surface of the image portion of the photoreceptor. When generated potential patterns were developed, it was observed on the surface of the photoreceptor that toners in each color adhered to the portion corresponding to the black portion of the original image in such a condition that the area each toner spreaded over the color separating portions was twice as great. After the toner image was transferred to a transfer sheet, the transfer sheet was taken out of the device and fed to a predetermined place, and fixed so as to obtain a color image. The toners which have adhered to the color separating portion spread out further, and as such, a favorable color reproduction and a high image density were realized.

When the lengths l of filter units in mosaic configuration of the photoreceptor were 300 micrometers, respectively, toners adhered to each of the filter units favorably. However, the superimpositions of toners in different colors were not recognized. The image obtained was low in its image density and the reproduction of blue, green, and red were unfavorable.

The toner images of the above-described examples were formed according to the normal image forming method. However, the method of the present invention can be applied to the color image forming method of carrying out a primary charge, secondary charge, image exposure and repeating uniform color light exposures, developments and re-charges after a re-charge is carried out. This method has been disclosed in Japanese patent application No. 229524/1985 (corresponding to Japanese Pat. O.P.I. publication No. 89071/1987). The method according to the present invention can be also applied to the photoreceptor having a color separating function and the method of forming a reverse image disclosed in Japanese Pat. O.P.I. publication Nos. 77857/1986, 77860/1986, 77861/1986, 65263/1986, and Japanese application No. 245177/1985 (corresponding to Japanese Pat. O.P.I. publication No. 105154/1987).

As described above, a color image formation according to the present invention is carried out by forming latent images in different positions and partly superimposing toners in different colors on the periphery of the color portion corresponding to the respective toners. Accordingly, the color tone is not reduced and the reproduction of the color tones of blue green, and red can be favorably accomplished. Further, the toner image whose image density is high and whose original colors are not lost can be obtained easily.

What is claimed is:

1. A method for forming a color image comprising steps of (a) uniformly applying a primary charge to a photoreceptor comprised thereon of a conductive substrate, a photoconductive layer and an electrically insulating layer, wherein one of said layers is provided with plural kinds of color separating means being finely divided into units, (b) exposing said photoreceptor to light given from a color original and simultaneously applying a secondary charge, said secondary charge being one of an alternating current and a direct current with a polarity opposite to that of said primary charge, (c) uniformly exposing said photoreceptor to a color light capable of passing through at least one kind of said color separating means to form an electrically charged image pattern, (d) developing said electrically charged pattern with a developer comprising a color toner by developing means to form a toner pattern and applying a charge which is one of an alternating current and a direct current with a polarity opposite to that of said primary charge, (e) repeating steps (c) and (d) at least once more, provided that the color light and the color toner each different from these in the every previous steps are used, (f) transferring said toner pattern onto an image pattern receiving materials, and (g) fixing said image patterns transferred on said image pattern receiving material, wherein an area of said toner image pattern formed on an individual unit of said color separating means is larger than an area of said individual unit in a ratio within the range of 1.1 to 10.0.

2. The method for forming a color image of claim 1, wherein said ratio is within the range of from 1.1 to 6.0.

3. The method for forming a color image of claim 1, wherein a gap between a surface of a sleeve of said developing means and the surface of said photoreceptor is within the range from 0.1 to 1.0 mm, a size of said individual unit of color separating means is within the range from 10 to 100 $\mu$m and a potential contrast of said charged image pattern is within the range from 500 to 1500 V.

4. The method for forming a color image of claim 1, wherein said plural kinds of color separating means comprise plural kinds of color filters, respectively.

* * * * *